166-250 SR

9/23/80 OR 4,223,725

United States Patent [19]

Teasdale et al.

[11] 4,223,725

[45] Sep. 23, 1980

[54] METHOD FOR RESERVOIR FLUID DRIFT RATE DETERMINATION

[75] Inventors: Thomas S. Teasdale; Wilton T. Adams, both of Houston, Tex.

[73] Assignee: Texaco Inc., White Plains, N.Y.

[21] Appl. No.: 972,837

[22] Filed: Dec. 26, 1978

[51] Int. Cl.[2] ..... F21B 47/10

[52] U.S. Cl. ..... 166/250; 73/155

[58] Field of Search ..... 166/250, 252; 73/155

[56] References Cited

U.S. PATENT DOCUMENTS

| | | | |
|---|---|---|---|
| 2,928,247 | 3/1960 | Hubbell | 166/250 X |
| 2,947,359 | 8/1960 | Josendal et al. | 166/250 |
| 3,345,868 | 10/1967 | Tenbrink | 166/250 |
| 3,372,746 | 3/1968 | Sanderson et al. | 73/155 X |
| 3,690,167 | 9/1972 | Chase, Jr. et al. | 73/155 |
| 3,799,261 | 3/1974 | Deans et al. | 166/250 |
| 3,902,362 | 9/1975 | Tomich et al. | 73/155 |
| 4,099,565 | 7/1978 | Sheely, Jr. et al. | 166/252 |

*Primary Examiner*—Stephen J. Novosad
*Assistant Examiner*—George A. Suchfield
*Attorney, Agent, or Firm*—Carl G. Ries; Robert A. Kulason; Gregory A. Cone

[57] ABSTRACT

The magnitude of fluid drift rate at a well in a reservoir is determined by first injecting a known volume of a fluid containing a tracer, then shutting in the well for a period of time to allow movement of the injected tracer fluid, then producing said well while systematically analyzing produced fluid samples to determine the produced tracer concentration and therefrom the magnitude of the fluid drift rate in the reservoir.

9 Claims, 1 Drawing Figure

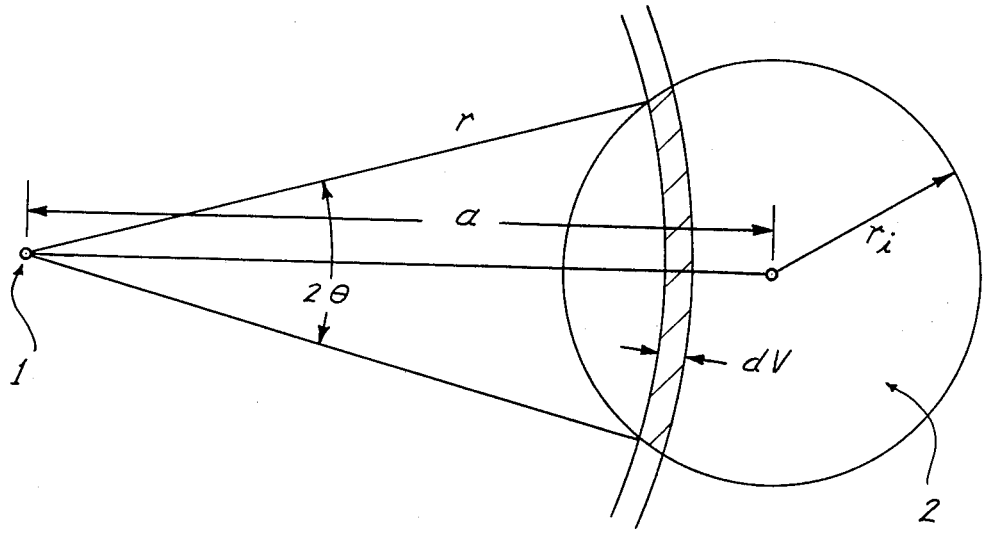
r
a
$r_i$
2θ
dV
1
2

METHOD FOR RESERVOIR FLUID DRIFT RATE DETERMINATION

BACKGROUND OF THE INVENTION

1. Field of the Invention

This invention relates to a method for determining the magnitude of the fluid drift rate in a formation penetrated by a well.

2. Description of the Prior Art

The determination of fluid drift rate in a reservoir is of major importance in obtaining a satisfactory understanding of the conditions within any given reservoir. The fluid drift rate represents the velocity of reservoir fluid particles as they pass through the zone of investigation, their movement being produced by forces outside the zone of investigation. Such information is critical to the prediction of such behavior as the motion of the injected fluid fronts through the reservoir and for the design of the most efficient pattern of injection and production wells for the exploitation of the fluids contained within the reservoir.

Heretofore the most common method for determining a fluid drift rate in a reservoir has been to inject a tracercontaining fluid into one injection well and then to monitor the surrounding production wells for the appearance of the tracer-containing fluid and calculating therefrom the fluid drift rate from the distance between said injection and production wells and the time necessary for the tracer to travel there between. Two disadvantages to this method are readily apparent. First, it is necessary to monitor several production wells in order to have a high probability that the tracer will break through into at least one of the production wells. Another disadvantage is that the injection well will commonly be separated from the production wells by distance of at least several hundred meters. Under such conditions the waiting time required between the injection of the tracer and its production at one of the monitor wells can easily take months.

There remains at this time a need for a method of determining the fluid drift rate in a reservoir which uses only one well and that can be practiced inexpensively within short time periods giving accurate results.

SUMMARY OF THE INVENTION

This invention concerns a method for determining the magnitude of the fluid drift rate within a reservoir. The method comprises the steps of first injecting a known volume of a tracer-containing fluid into the reservoir, then waiting for a period of time sufficient to allow movement of the injected tracer containing fluid under the influence of the reservoir fluid drift rate, then producing fluids from said well while systematically analyzing produced fluid samples to determine the produced fluid tracer concentration, and finally calculating therefrom the magnitude of the fluid drift rate in the reservoir.

BRIEF DESCRIPTION OF THE DRAWING

The FIGURE is an analytical diagram portraying in plan view the physical relationships between the well and the tracer slug.

DESCRIPTION OF THE PREFERRED EMBODIMENTS

The tracer used in the practice of this invention can be any one of several well-known tracers such as potassium iodide, ammonium thiocyanate, sodium bromide, ammonium nitrate, sodium nitrite, picric acid, lithium chloride, glycene salicylic acid, or any one of a number of other suitable tracer chemicals. Such radioactive compounds as tritium as $H_2{}^3O$, thalium-204 as a chloride, carbon-14 as $Na_2C^{14}O_3$ or iodide as sodium or ethyl iodide, and sulphur-35 as $Na_2S^{35}O_4$ could also be used as tracers. In reservoirs containing saline formation waters, fresh water could be used as a tracer.

The volume of injected fluid containing the tracer chemical would be dependent upon the formation thickness, porosity, and the desired equivalent radius of the injected volume of the tracer fluid within the reservoir. An equivalent radius of between one and ten meters should be adequate.

The optimum shut-in period would be a function of the equivalent tracer radius and the formation fluid drift rate. A shut-in time period of from 1 to 20 times the time required for injection should be adequate.

At the end of the waiting period the well would be put on production at a rate sufficient to render the dispersion and drift effects negligible. In one preferred embodiment the injection and production rates are equal. The produced fluids would be monitored for tracer concentration as a function of either time or quantity of produced fluids.

These data are then analyzed to determine the fluid drift rate within the reservoir. In one embodiment of the present invention the drift rate can be calculated from the tracer response time versus the tracer concentration by "curve fitting" the field data with various theoretically developed response curves for different magnitudes of drift using the appropriate tracer injection and production rates and shut-in periods.

These hypothetical tracer concentration response curves would fall into three classes. The first comprises a condition of no drift and is marked by immediate tracer concentration response which continues at a constant rate until an abrupt cut-off point marking the production of the last portion of the injected tracer from the reservoir at which time the tracer concentration rapidly drops to zero. The area under this curve represents the amount of produced tracer and should equal the amount of injected tracer. The second class of tracer response curves is produced by the condition wherein the injected volume of tracer has been partially displaced from the vicinity of the well bore. This curve is marked initially by a high and constant produced tracer concentration which later begins to gradually taper to zero concentration as the last of the tracer is produced from the formation. This taper begins when the formation fluids containing no tracer start to break through from the upstream side of the injected tracer slug. Tracer concentration then diminishes at a relatively constant rate until all of the tracer is produced from the formation. The third class of produced tracer concentration curves is generated by high drift rate and/or long shut-in periods wherein the injected tracer slug has moved completely away from the well bore and there is a delay in tracer concentration response after the production phase is started. Such curves would be marked by a gradual increase in tracer concentration followed by a gradual decline in produced tracer concentration. Once again, the area under this curve represents the amount of produced tracer and should equal the amount of injected tracer. All of these hypothetical tracer concentration response curves assume negligible diffusion or dispersion effects and negligible drift effects during the injection and production periods. However, in practice these effects, particularly the latter, might have to be considered in interpreting the tracer concentration curve to determine the drift magnitude.

Comparison of the curves made from the field data with thereotically determined tracer response curves for identical reservoir characteristics and various known drift rates would then enable one skilled in the art to readily determine the formation fluid drift rate at the tested well.

In another embodiment of this invention, the drift rate $u_o$ can be calculated directly given the following information: the injected tracer concentration $C_i$, the formation thickness h, the formation porosity $\phi$, the immobile oil saturation $S_o$, the injection flow rate $q_i$, the injection period $t_i$, the shut-in period $t_d$, the production flow rate $q_p$, and the produced tracer concentration $C_p$.

In the large majority of cases the tracer can be injected quickly enough to make the drift rate small by comparison to the tracer's frontal velocity. The tracer slug can be considered cylindrical with the injector well as its axis. Its volume $V_i$ will be:

$$V_i = q_i t_i = \pi r_i^2 h\phi\,(1-S_o) \tag{1}$$

The tracer slug radius $r_i$ is obtained by solving equation 1:

$$r_i = \sqrt{\frac{q_i t_i}{\pi h\phi(1-S_o)}} \tag{2}$$

Shutting-in the injector for time $t_d$ will allow the slug to drift downstream for a distance a where:

$$a = u_o t_d \tag{3}$$

The slug will retain its shape, but will no longer be centered on the well. If the drift time $t_d$ is long enough, the injector may no longer be immersed in tracer but in reservoir fluids. If the drift time is short, the injector will still be immersed in tracer. The time required for breakthrough $t_{BT}$ will be that time required for the point on the tracer slug periphery closest to the well to travel to the well. This distance is $r_p$ where:

$$r_p = \pm(a - r_i) \tag{4}$$

The plus sign is used for long $t_d$ and the minus sign for short $t_d$. Since all points at a distance $r_p$ from the well will be produced by time $t_{BT}$, $r_p$ defines a drained area of the reservoir, cylindrical in shape with $r_p$ as its radius and the well bore as its axis. The produced volume $V_p$ is given by:

$$V_p = q_p t_{BT} = \pi r_p^2 h\phi(1-S_o) \tag{5}$$

Solving for a drained volume radius $r_p$:

$$r_p = \sqrt{\frac{q_p t_{BT}}{\pi h\phi(1-S_o)}} \tag{6}$$

Substituting equations 2, 3, and 6 into 4:

$$\sqrt{\frac{q_p t_{BT}}{\pi h\phi(1-S_o)}} = \pm\left(u_o t_d - \sqrt{\frac{q_i t_i}{\pi h\phi(1-S_o)}}\right) \tag{7}$$

Solving for drift rate:

$$u_o = \frac{\sqrt{\frac{q_i t_i}{\pi h\phi(1-S_o)}} \pm \sqrt{\frac{q_p t_{BT}}{\pi h\phi(1-S_o)}}}{t_d} \tag{8}$$

The plus sign is used if the first fluids produced do not contain significant levels of tracer; the minus sign if they do.

For equal production and injection rates equation 8 reduces to:

$$u_o = \sqrt{\frac{\frac{q_i}{\pi h\phi(1-S_o)}}{t_d}}\left(\sqrt{t_i} \pm \sqrt{t_{BT}}\right) \tag{9}$$

As production continues beyond breakthrough the tracer concentration will vary until the slug is completely produced. The produced tracer concentration will depend on how much of the tracer slug is included in the drained volume as defined by equation 5.

The drawing is a useful diagram to illustrate one method of analyzing the situation at some time t after breakthrough, where 1 is the well and 2 is the injected tracer slug.

During the time between t and t+dt the volume dv is produced. The original location of this volume was a thin torus centered on the well of radius r and circumference $2\pi r$. Of this circumference, the arc $2\theta r$ was within the tracer slug as shown in FIG. 1. Since the entire circumference is produced at the same instant and $2\theta r/2\pi r$ of it is at the tracer concentration $C_i$ then the produced concentration $C_p$ is given by:

$$\frac{C_p}{C_i} = \frac{\theta}{\pi} \tag{10}$$

The drift rate $u_o$ can be derived from the produced tracer concentration. Consider the triangle formed by the tracer slug radius $r_i$, a drift distance a and the drained radius r at some time t. Applying the low of cosines to this triangle gives:

$$r^2 + a^2 - 2ra\cos\theta = r_i^2 \tag{11}$$

Substituting equation 3 for a and solving for drift rate $u_o$ gives:

$$u_o = \frac{r}{t_d}\left[\cos\theta + \sqrt{\left(\frac{r_i}{r}\right)^2 - \sin^2\theta}\right] \tag{12}$$

In this equation, $r_i$ is given by equation 2, r by equation 6 (with $r_p$ and $t_{bt}$ generalized to r and t), while $\theta$ is obtained from 10, giving:

$$\theta = \frac{\pi C_p}{C_i} \tag{12a}$$

By substituting equation 11 into equation 12a the tracer concentration history can be obtained as:

$$C_p = \frac{C_i}{\pi} \text{ arc cos} \left[ \frac{r^2 + a^2 - r_i^2}{2ra} \right] \tag{13}$$

Assuming the derivative with time equal to 0 and solving for time gives the time at which the produced tracer is at a maximum concentration. This time is:

$$t_{Cmax} = \frac{a^2 - r_i^2}{\left( \frac{q_p}{\pi h \phi (1 - S_o)} \right)} \tag{14}$$

Substituting equation 14 into 6 and thence into 13 gives $C_{max}$.

The drift rate can also be calculated from the maximum concentration data. Substituting $u_o t_d$ for a from equation 3 into equation 14 and solving for $u_o$ yields:

$$u_o = \frac{\sqrt{\frac{t_{Cmax} q_p + q_i t_i}{\pi h \phi (1 - S_o)}}}{t_d} \tag{14a}$$

This particular calculation is useful in situations where $t_{BT}$ cannot be accurately measured due to a lack of a clearly defined inflection in the produced tracer concentration data marking the time of breakthrough.

Equation 13 applies from breakthrough (of either tracer or reservoir fluids) until the entire tracer slug is produced when at which time the tracer concentration drops to zero. At this point the drained radius $r_p$ is:

$$r_p = r_i + a \tag{15}$$

The drained radius at breakthrough is:

$$r_p = r_i - a \tag{15a}$$

Several assumptions are implicit in this method of estimating drift rate. The first assumption is that the injection and production rates are constant. If not, the time-rate products qt are replaced with the integral:

$$\int_o^t q(t)dt$$

Another assumption is that the dispersion rate is low. If not, the effluent concentration curves will be altered slightly but not significantly. Another assumption is that the drift rate $u_o$ is insignificant during injection and production. A reasonable criteria is that for a flow rate q after any time t, especially after the entire tracer slug has been produced:

$$\frac{2\pi \phi u_o^2}{1/h} t < .1 \tag{16}$$

Checking this ratio after determining $u_o$ will confirm the accuracy of the value for $u_o$. The last assumption is that the thickness h is small. If not, the flow rate q must apply to a particular zone Δh where vertical conformance is good. Alternately, the treatment can be extended to apply to zones of different injectivities.

The assumptions employed above were used only for the purpose of illustrating the invention in its simplest form. These assumptions can easily be removed by using a more sophisticated analysis. Such an analysis is within the competence of anyone skilled in the art of calculating fluid flow in porous media.

The following examples are offered to more fully illustrate the practice of this invention but should not, however, be considered as limitative.

EXAMPLE I

A 20-foot thick formation of 23.5% porosity and 15% oil saturation is injected with a 1000 ppm tracer solution for 2 days at a rate of 50 barrels per day. The well is shut in for two months then produced at 50 barrels per day. Tracer breaks through after 1 hour.

The injected slug has a radius of:

$$r_i = \sqrt{\frac{q_i t_i}{\pi h \phi (1 - S_o)}} = \sqrt{\frac{(50)\ (5.615)\ (2)}{\pi (20)\ (.235)\ (1 - .15)}} = 6.688'$$

The drained area has a radius of:

$$r_p = \sqrt{\frac{q_p t_{BT}}{\pi h \phi (1 - S_o)}} = \sqrt{\frac{(50)\ (5.615)\ (1/24)}{\pi (20)\ (.235)\ (1 - .15)}} = .965'$$

Therefore, the slug has traveled:

$$a = 6.685 + 0.965 = 7.65'$$

producing a drift rate of:

$$(7.65/60 = 0.127 \text{ ft/day} = u_o$$

Alternatively the drift rate is obtained from equation 8 directly.

At this point the tracer production can be predicted from equation 13:

$$C = 318 \text{ arc cos } (0.309\sqrt{t} + 0.191/\sqrt{t})$$

This applies from tracer breakthrough at one hour until total slug production. From equations 15 and 16 this time is 9.195 days. The maximum concentration during this time span is 338 ppm from equation 14. This occurs at 14.9 hours after the start of production.

Finally, checking with equation 13:

$$\frac{2\pi u_o^2}{q/h} t = .00722t < .1 \longrightarrow t < 13.85 \text{ days}$$

Even after producing the entire tracer slug the time elapsed 9.2 days is comfortably within the applicability criteria of 13.9 days as set forth in equation 16.

EXAMPLE II

A 40 foot formation of 13.4% porosity and 25% oil saturation is flooded with 1000 ppm tracer for 30 hours at 200 barrels per day. The well is shut in for five weeks; then produced at 50 barrels a day. Tracer is produced immediately, but after 20 hours its concentration has dropped to 650 ppm.

Since the production rate is a quarter of injection rate, with no drift it would have taken 120 hours to produce the tracer slug, at which time its concentration would drop abruptly to zero. Since tracer is produced immediately, the well is still immersed in the slug, so the drift rate must be less than $r_i/t_d$:

$$u_o < \frac{r_i}{t_d} = \frac{\sqrt{\frac{q_i t_i}{\phi \pi h(1 - S_o)}}}{t_d} = \frac{\sqrt{\frac{(200)\ (30/24)\ (5.615)}{(.134)\pi(40)\ (1 - .25)}}}{35}$$

$$= .301 \text{ ft./d}$$

and $r_i = 10.54$ ft.

The produced radius r is:

$$r = \sqrt{\frac{q_p t}{\phi \pi h(1 - S_o)}} = \sqrt{\frac{(50)\ (20/24)\ (5.615)}{(.134)\pi(40)\ (1 - .25)}} = 4.30 \text{ ft.}$$

From equation 10:

$$\theta = \frac{C_p}{C_i}\pi = \frac{650\pi}{1000} = 2.04 \text{ rad} = 117°$$

Then from equation 12:

$$u_o = \frac{4.30}{14}\left[\cos 117° + \sqrt{\left(\frac{10.54}{4.30}\right)^2 - \sin^2 117°}\right] = .22 \text{ ft/d}$$

An analyzed tracer concentration of 600 ppm would change this drift rate to 0.24 ft/da, whereas a 500 ppm concentration gives 0.15 ft/da. The applicability criterion, equ. 16, gives $$\frac{2\pi\phi u_o^2 t}{q/h} = .027$$

This is less than 0.1, and in fact indicates that a shorter shut-in time could be tried in subsequent drift determinations.

What is claimed is:

1. In an underground reservoir penetrated by at least one well, a method for determining the magnitude of fluid drift rate in the reservoir consisting essentially of:
   a. injecting into a well which penetrates said reservoir a known volume of a fluid containing a tracer chemical,
   b. shutting in said well for a period of time to allow movement of the injected tracer containing fluid,
   c. producing said well while systematically analyzing produced fluid samples to determine the produced tracer concentration, and
   d. calculating therefrom the magnitude of the fluid drift rate in the reservoir.

2. The method of claim 1 wherein the method of calculating the magnitude of the fluid drift rate comprises:
   a. establishing a functional relationship of the produced fluid tracer concentration as a function of time from the field data;
   b. developing a theoretically derived functional relationship of produced fluid tracer concentration as a function of time for at least one known drift rate from a reservoir model which duplicates as nearly as possible the conditions present in the reservoir of interest;
   c. comparing the functional relationship derived from the field data with the theoretically derived functional relationships for the different drift rates; and
   d. determining therefrom the magnitude of the fluid drift rate in the reservoir by selecting the fluid drift rate from the theoretically derived functional relationship which correlates most closely with the functional relationship derived from the field data.

3. The method of claim 1 wherein the method of calculating the magnitude of the fluid drift rate comprises:

given values for the injection rate $q_i$, the production rate $q_p$, the time for the injection phase $t_i$, the time for the waiting period $t_d$, the time for breakthrough $t_{BT}$, the thickness of the reservoir h, the porosity of the reservoir $\Phi$, and the residual oil saturation $S_o$; solving the equation below for the fluid drift rate $u_o$ where $$u_o = \frac{\sqrt{\frac{q_i t_i}{\pi h \phi(1 - S_o)}} \pm \sqrt{\frac{q_p t_{BT}}{\pi h \phi(1 - S_o)}}}{t_d}$$

wherein the plus sign is used if the first fluids produced do not contain significant amounts of the tracer and the minus sign is used if the first fluids produced do contain significant amounts of the tracer.

4. The method of claim 1 wherein the method of calculating the magnitude of the fluid drift rate comprises:

given values for the injection rate $q_i$, the production rate $q_p$, the time for the injection phase $t_i$, the time for the waiting period $t_d$, the time for production of the maximum tracer concentration $t_{Cmax}$, the thickness of the reservoir h, the porosity of the reservoir $\Phi$, and the residual oil saturation $S_o$; solving the equation below for the fluid drift rate $u_o$ where $$u_o = \frac{\sqrt{\frac{t_{Cmax} q_p + q_i t_i}{\pi h \phi(1 - S_o)}}}{t_d}$$

5. The method of claim 1 wherein the injection rate into the well is equal to the production from the well.

6. The method of claim 1 wherein the fluid samples are analyzed continuously.

7. The method of claim 1 wherein the tracer is a radioactive material.

8. The method of claim 1 wherein the fluids contained within the reservoir comprise petroleum liquids and water.

9. The method of claim 1 wherein the tracer is selected from the group consisting of potassium iodide, ammonium thiocyanate, sodium bromide, ammonium nitrate, sodium nitrate, picric acid, lithium chloride, glycene salicyclic acid and mixtures thereof.

* * * * *

UNITED STATES PATENT AND TRADEMARK OFFICE

CERTIFICATE OF CORRECTION

PATENT NO. : 4,223,725

DATED : September 23, 1980

INVENTOR(S) : Thomas S. Teasdale and Wilton T. Adams

It is certified that error appears in the above-identified patent and that said Letters Patent are hereby corrected as shown below:

Claim 9, col. 8, line 66, "sodium nitrate" should read --sodium nitrite--.

Signed and Sealed this

*Twenty-seventh* Day of *January 1981*

[SEAL]

*Attest:*

RENE D. TEGTMEYER

*Attesting Officer*

*Acting Commissioner of Patents and Trademarks*